US012622503B2

(12) United States Patent
Chinn

(10) Patent No.: US 12,622,503 B2
(45) Date of Patent: May 12, 2026

(54) COSMETIC PRODUCT DISPENSING CONTAINER

(71) Applicant: Douglas Alan Chinn, Albuquerque, NM (US)

(72) Inventor: Douglas Alan Chinn, Albuquerque, NM (US)

( * ) Notice: Subject to any disclaimer, the term of this patent is extended or adjusted under 35 U.S.C. 154(b) by 390 days.

(21) Appl. No.: 18/099,762

(22) Filed: Jan. 20, 2023

(65) Prior Publication Data

US 2024/0245196 A1 Jul. 25, 2024

(51) Int. Cl.

*A45D 40/06* (2006.01)
*A45D 40/20* (2006.01)
*A45D 40/00* (2006.01)

(52) U.S. Cl.

CPC ..... *A45D 40/06* (2013.01); *A45D 40/205* (2013.01); *A45D 2040/0025* (2013.01)

(58) Field of Classification Search

CPC ..... A45D 40/04; A45D 40/06; A45D 40/205; A45D 2040/0025

USPC ..... 401/68, 75, 175

See application file for complete search history.

(56) References Cited

U.S. PATENT DOCUMENTS 1,203,308 A * 10/1916 Brown ..... A46B 11/0027 401/266
4,890,944 A * 1/1990 Cousins ..... A45D 40/04 401/98
5,150,978 A * 9/1992 Stewart ..... A63C 11/08 401/98

* cited by examiner

*Primary Examiner* — Jennifer C Chiang
(74) *Attorney, Agent, or Firm* — Kameron W. Kramer

(57) ABSTRACT

A dispensing container has a product tube that has a top opening and a bottom opening. An internal thread is formed on an inner surface of the product tube. A ram tube has a threaded exterior surface that extends from a proximal end and a distal end. A product support platform is mounted on the distal end of the ram tube. The threaded exterior surface of the ram tube threadedly engages the internal thread of the product tube, such that rotation of the ram tube advances the product support platform and dispenses cosmetic product from the top opening of the product tube.

13 Claims, 3 Drawing Sheets

COSMETIC PRODUCT DISPENSING CONTAINER

TECHNICAL FIELD

This invention relates generally to dispensing containers, and more particularly to a cosmetic product dispensing container for dispensing deodorant, lipstick, toothpaste, and similar cosmetic products which are applied to the skin of a user.

PRIOR ART

The prior art teaches a variety of dispensers for cosmetic products for dispensing deodorant, lipstick, and similar cosmetic products. For example, Haynes, U.S. 2014/0126948, teaches a deodorant dispenser that includes a tubular body that contain deodorant. Platforms are advanced upon threaded screws when knobs are turned by the consumer. While the Haynes dispenser includes two different types of deodorants which are dispensed from opposed ends of the tubular body, the general construction is identical to dispensing containers that have been used in the art for decades.

SUMMARY OF THE INVENTION

The present invention teaches certain benefits in construction and use which give rise to the objectives described below.

The present invention provides a dispensing container for dispensing a cosmetic product. The dispensing container includes a product tube that has an inner surface and an outer surface, which extend from a top opening and a bottom opening. An internal thread is formed on the inner surface of the product tube. A ram tube has an exterior surface that extends from a proximal end and a distal end. A product support platform is mounted on the distal end of the ram tube, the product support platform having an outer perimeter that has a diameter that is smaller than inner diameter of the product tube. An outer thread is disposed on the outer perimeter of the product support platform, or at least a portion of the exterior surface of the ram tube adjacent the distal end.

A primary objective of the present invention is to provide a dispensing container having advantages not taught by the prior art.

Another objective is to provide a dispensing container that is superior in function and inexpensive to manufacture.

A further objective is to provide a dispensing container that is easier to recycle.

Certain embodiments of the invention have other steps or elements in addition to or in place of those mentioned above. The steps or element will become apparent to those skilled in the art from a reading of the following detailed description when taken with reference to the accompanying figures, if any.

DETAILED DESCRIPTION OF THE INVENTION

Figure 1:
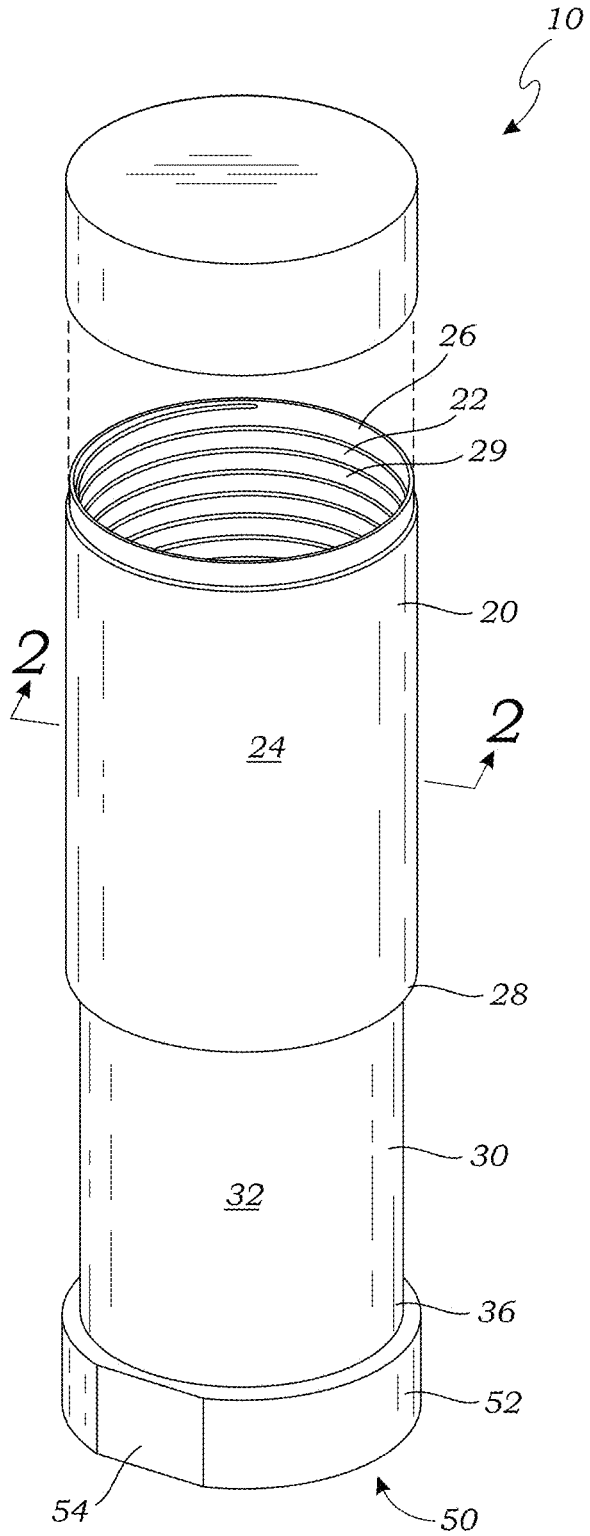
FIG. 1 is a perspective view of a dispensing container according to one embodiment of the present invention, illustrating the dispensing container in an empty condition.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system, if any, are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the present apparatus, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures, if any. The term "on" means that there is direct contact among elements.

The above-described drawing figures illustrate the invention, a dispensing container for dispensing a cosmetic product such as deodorant, lipstick, toothpaste, or other product intended for application to the skin of a user.

Figure 2:
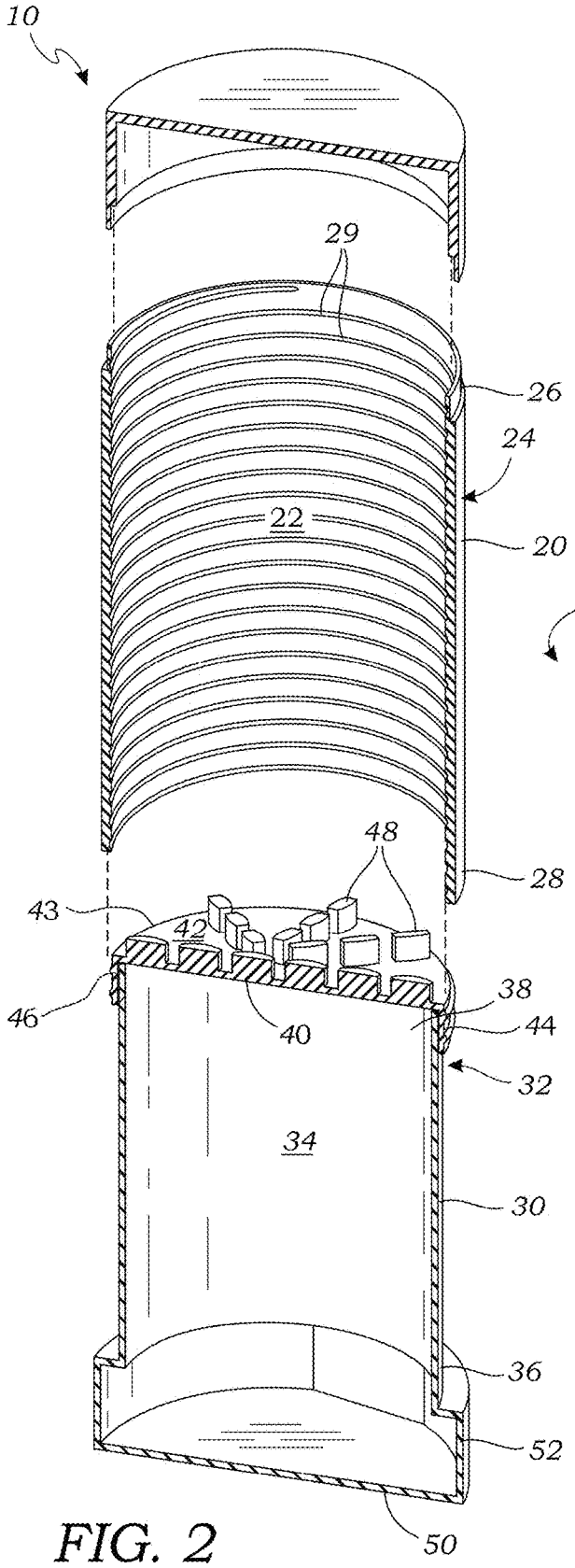
FIG. 2 is a sectional view thereof taken along line 2-2 in FIG. 1.

FIG. 1 is a perspective view of a dispensing container 10 according to one embodiment of the present invention, illustrating the dispensing container 10 in an empty condition (without any cosmetic product having been added). FIG. 2 is a sectional view thereof taken along line 2-2 in FIG. 1. As shown in FIGS. 1-2, the dispensing container 10 includes a product tube 20 and a ram tube 30 which engage each other for holding and dispensing the cosmetic product (shown in FIG. 3).

As shown in FIGS. 1-2, the product tube 20 has an inner surface 22 and an outer surface 24, which extend from a top opening 26 and a bottom opening 28. An internal thread 29 is disposed on the inner surface 22 of the product tube 20. In this embodiment, the product tube 20 is a cylindrical tube that is constructed of aluminum; however, it may alternatively be constructed of plastic or any other desired material. The internal thread 29 may be formed by stamping or otherwise shaping the product tube 20, or it may be machined or otherwise formed in the product tube 20. The product tube 20 is sized and shaped to hold a suitable amount of the cosmetic product, typically 2-5 oz, although any desired size may be used.

As shown in FIGS. 1-2, the ram tube 30 in this embodiment has an exterior surface 32 (shown in FIG. 2) and an interior surface 34 that together extend from a proximal end 36 and a distal end 38. In this embodiment, the ram tube 30 is cylindrical, and has a smaller diameter than a larger diameter of the product tube 20, although the difference is preferably small enough so that the two components can threadedly engage one another, as discussed in greater detail below.

Figure 4:
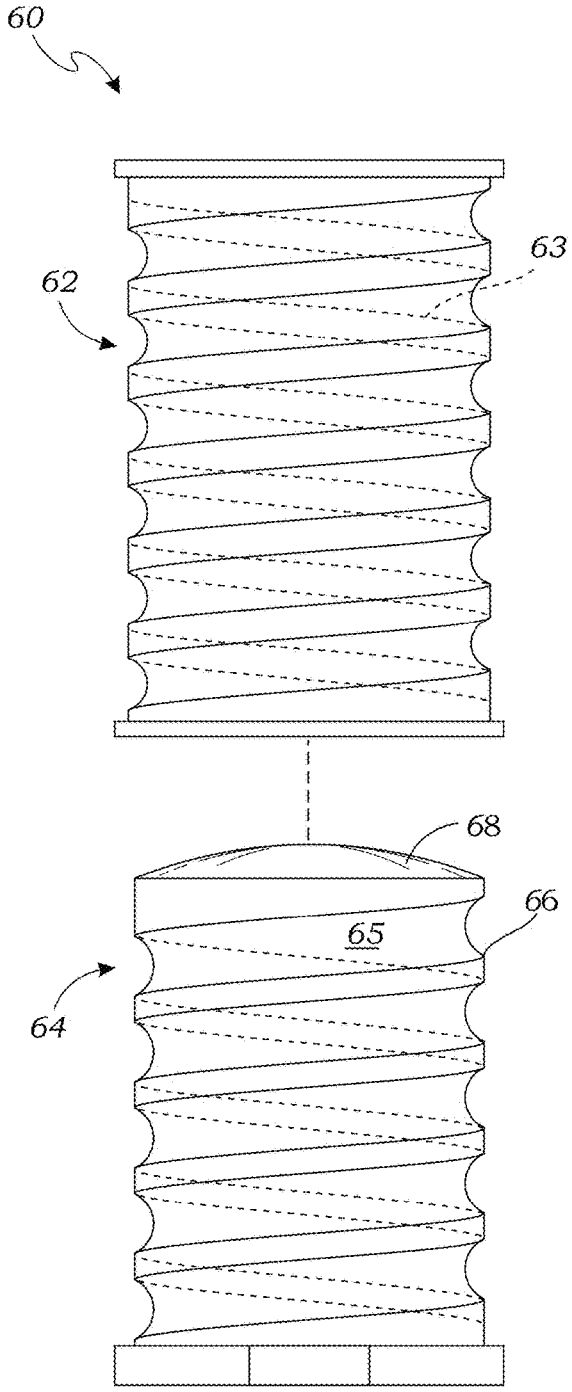
FIG. 4 is an exploded side elevation view of a second embodiment of the dispensing container.
Figure 5:
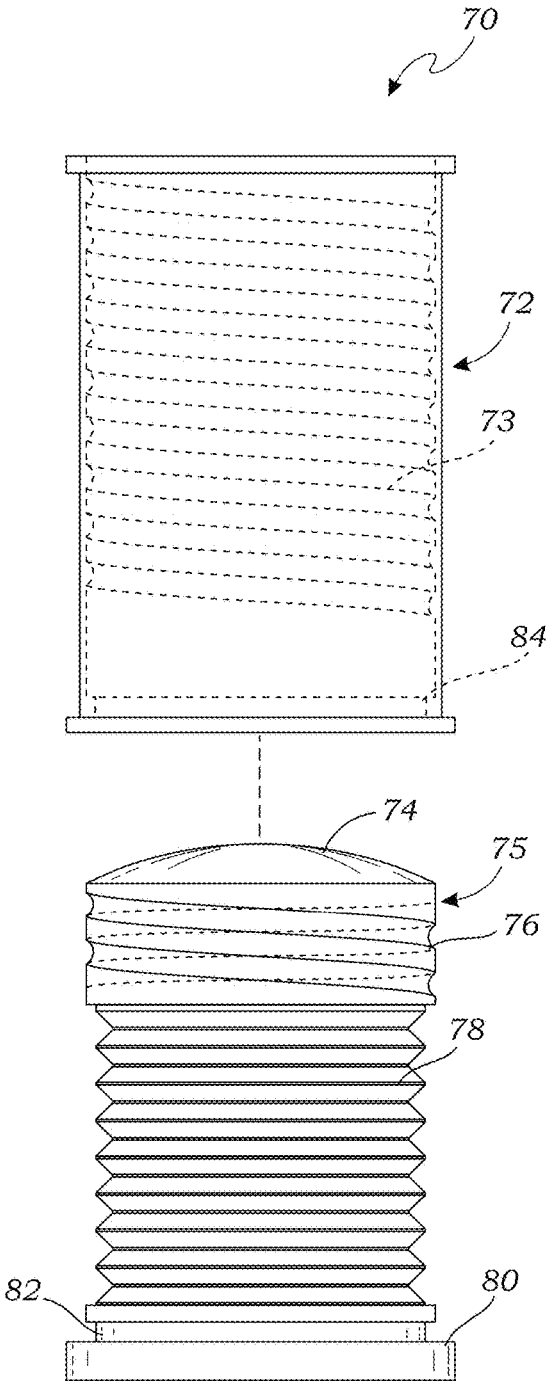
FIG. 5 is an exploded side elevation view of a third embodiment of the dispensing container.

As shown in FIG. 2, a product support platform 40 is mounted on the distal end 38 of the ram tube 30. For purposes of this application, "mounted on" is defined to include any form of attachment, welding, integral formation, or other connection between the two components. The product support platform 40 has a top surface 42 that extends to an outer perimeter 43 that has a diameter that is slightly smaller than an inner diameter of the product tube 20. For purposes of this application the term "slightly smaller" is defined to mean they are small enough to fit together and threadedly engage one another, as described herein. An outer thread 46 disposed on an outer structure 44 of the outer perimeter 43 of the product support platform 40 threadedly engages the internal thread 29 of the inner surface 22 of the product tube 20. In this embodiment, the outer structure 44 is in the form of a downwardly extending flange with a threaded outer surface; however, other structures that properly engage the product tube 20 are also considered within the scope of the present invention. In other embodiments, discussed below, at least a portion of the exterior surface of the ram tube 30 may also (or alternatively) be externally threaded adjacent the distal end. Some examples of this are shown in FIGS. 4 and 5, and are discussed in greater detail below.

Figure 3:
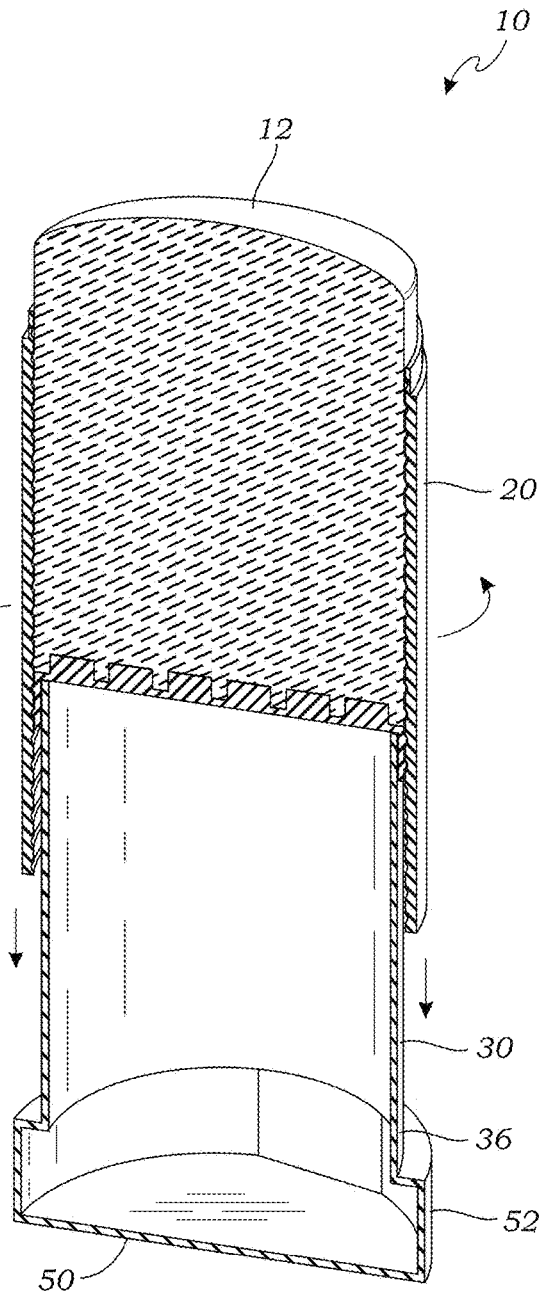
FIG. 3 is a sectional view similar to FIG. 2, illustrating the dispensing container once it has been filled with a cosmetic product, and illustrating how the dispensing container is twisted to dispense the cosmetic product.

FIG. 3 is a sectional view similar to FIG. 2, illustrating the dispensing container 10 once it has been filled with a cosmetic product 12. FIG. 3 also illustrates how the dispensing container 10 is twisted to dispense the cosmetic product 12. As shown in FIG. 3, when the dispensing container 10 is twisted, the product tube 20 being rotated relative to the ram tube 30, the threads cause the product support platform 40 to move upwardly with respect to the product tube 20, thereby dispensing the cosmetic product 12. A plurality of protrusions 48 that may be provided to extend upwardly from the top surface 42 of the product support platform 40 help form a secure connection with the cosmetic product 12 and the product support platform 40. While protrusions 48 are shown in the current embodiment, other structures and methods known in the art may alternatively be used, or they may be omitted, if they are not deemed needed in a particular embodiment.

As shown in FIGS. 1-3, a support base 50 may be mounted on the proximal end 36 of the ram tube 30. The support base 50 may include an outwardly extending rim 52 that has a base diameter that is larger than an outer diameter of the ram tube 30. The outwardly extending rim 52 may include a pair of opposed gripping surfaces 54 (shown in FIG. 1) that are flat or depressed inwardly to facilitate gripping the outwardly extending rim 52 for twisting the ram tube 30 relative to the product tube 20 for dispensing the cosmetic product 12 out of the top opening of the product tube 20 (as shown in FIG. 3).

In the current embodiment, the product tube 20 and the ram tube 30 are both constructed entirely of aluminum. In one embodiment, the entire construction of the dispensing container 10 is made of aluminum; however, in alternative embodiments, any components may be made of plastic, or any other material deemed suitable by the product designer.

FIG. 4 is an exploded side elevation view of a second embodiment of the dispensing container 60. In the embodiment of FIG. 4, the dispensing container 60 includes a product tube 62 that is entirely stamped, bent, or otherwise formed to have an inner thread 63. At least a portion of the exterior surface 65 of the ram tube 64 (in this case all of the exterior surface) may be externally threaded 66. The threaded exterior surface 65 of the ram tube 64 threadedly engages the internal thread 63 of the product tube 62, such that rotation of the ram tube 64 relative to the product tube 62 advances the product support platform 68 and dispenses cosmetic product (not shown) from the top opening of the product tube 62.

FIG. 5 is a side elevation view of another embodiment of a dispensing container 70. In this embodiment the product tube 72 includes an internal thread 73, and another embodiment of a product support platform 74 has an external surface 75 that includes a thread 76 shaped to threadedly engage the product tube 72. In this embodiment, the ram tube 78 is in the form of a bellows to allow expansion of the length of the ram tube 78 as the product is dispensed. A bottom closure 80 is provided at the bottom of the ram tube 78. In this embodiment, the bottom closure 80 includes an annular groove 82 that engages an annular ridge 84 of the product tube 72, to hold the ram tube 78 in place while allowing rotation to advance or retract the ram tube 78.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying figures are to be interpreted in an illustrative and non-limiting sense.

What is claimed is:

1. A dispensing container for dispensing a cosmetic product, the dispensing container comprising:

a product tube that has an inner surface and an outer surface, which extend from a top opening and a bottom opening;

an internal thread on the inner surface of the product tube, wherein substantially the entire inner surface is threaded;

a ram tube that has an exterior surface that extends from a proximal end and a distal end, wherein the ram tube is in the form of a bellows to allow expansion of the length of the ram tube;

a product support platform that is mounted on the distal end of the ram tube, the product support platform having an outer perimeter that has a diameter that is slightly smaller than inner diameter of the product tube, wherein protrusions are disposed on the product support platform; and an outer thread disposed on the outer perimeter of the product support platform.

2. The dispensing container of claim 1, further comprising a support base mounted on the proximal end of the ram tube.

3. The dispensing container of claim 2, wherein the support base mounted on the proximal end of the ram tube includes an outwardly extending rim that has a base diameter that is larger than an outer diameter of the ram tube.

4. The dispensing container of claim 3, wherein the outwardly extending rim includes a pair of opposed gripping surfaces that are depressed inwardly to facilitate gripping the outwardly extending rim for twisting the ram tube relative to the product tube for dispensing the cosmetic product out of the top opening of the product tube.

5. The dispensing container of claim 1, wherein the ram tube and the product tube are made of aluminum.

6. The dispensing container of claim 5, wherein the internal thread on the inner surface of the product tube is formed by stamping the product tube.

7. A dispensing container for dispensing a cosmetic product, the dispensing container comprising:

a product tube that has an inner surface and an outer surface, which extend from a top opening and a bottom opening, wherein an internal thread is disposed on the inner surface of the product tube;

a ram tube that has an exterior surface that extends from a proximal end and a distal end, wherein the ram tube is in the form of a bellows to allow expansion of the length of the ram tube, wherein a product support platform is disposed on the distal end of the ram tube and has a top surface, wherein the product support platform has an outer perimeter that has a diameter that is slightly smaller than inner diameter of the product tube and slightly larger than the ram tube, wherein an outer structure is disposed on the outer perimeter of the product support platform, wherein an outer thread is disposed on the outer structure of the product support platform, and wherein one or more protrusions are disposed on the top surface of the product support platform and extend upwardly from the product support platform.

8. The dispensing container of claim 7, further comprising a support base mounted on the proximal end of the ram tube.

9. The dispensing container of claim 8, wherein the support base mounted on the proximal end of the ram tube includes an outwardly extending rim that has a base diameter that is larger than an outer diameter of the ram tube.

10. The dispensing container of claim 9, wherein the outwardly extending rim includes a pair of opposed gripping surfaces that are depressed inwardly to facilitate gripping the outwardly extending rim for twisting the ram tube relative to the product tube for dispensing the cosmetic product out of the top opening of the product tube.

11. The dispensing container of claim 7, wherein substantially the entire inner surface is threaded.

12. The dispensing container of claim 7, wherein the ram tube and the product tube are made of aluminum.

13. The dispensing container of claim 12, wherein the internal thread on the inner surface of the product tube is formed by stamping the product tube.

* * * * *